United States Patent [19]

Moriya

[11] 4,115,993

[45] Sep. 26, 1978

[54] DIGITAL ALARM WATCH

[75] Inventor: Tokio Moriya, Tokyo, Japan

[73] Assignee: Kabushiki Kaisha Daini Seikosha, Japan

[21] Appl. No.: 730,430

[22] Filed: Oct. 7, 1976

[30] Foreign Application Priority Data

Oct. 13, 1975 [JP] Japan ..... 50-123013

[51] Int. Cl.[2] ..... G04B 23/13; G04C 21/12

[52] U.S. Cl. ..... 58/38 R; 58/21.11; 58/57.5

[58] Field of Search ..... 58/19 C, 21.11, 21.15, 58/38, 57.5, 152 B

[56] References Cited

U.S. PATENT DOCUMENTS

| | | | |
|---|---|---|---|
| 3,533,226 | 10/1970 | Rita et al. | 58/152 R |
| 3,813,533 | 5/1974 | Cone et al. | 58/50 R |
| 3,834,153 | 9/1974 | Yoda | 58/38 R |

*Primary Examiner*—Edith S. Jackmon

*Attorney, Agent, or Firm*—Robert E. Burns; Emmanuel J. Lobato; Bruce L. Adams

[57] ABSTRACT

A digital alarm timepiece including a time standard for generating a time standard signal, a divider for dividing the time standard signal and developing a repetitive output signal, and a counter receptive of the divider output signal for counting the same and for developing a count representative of time and date. A date-second switching circuit cooperates with the counter for switching between a count representative of seconds and a count representative of date. A plurality of memory circuits define respective channels and each stores a time signal representative of a time. A display responds to the contents of the counter and to the time signals for displaying a time corresponding thereto. A channel selecting switch applies a selected one of the time signals stored in one of the memories or the counts switched by the date-second switching circuit for displaying a selected time or date or seconds. A coincidence circuit compares the count developed by the counter with the time signals stored in the memories and develops an output signal when the count and one of the time signals coincide. An alarm responds to the coincidence circuit output signal for developing an alarm signal. The channel selecting circuit, the date-second switching circuit, and the alarm are controlled by a plurality of manually operable switches.

1 Claim, 2 Drawing Figures

DIGITAL ALARM WATCH

BACKGROUND OF THE INVENTION

This invention relates to a digital alarm watch, and it particularly relates to switching circuitry for operation of said digital watch.

Generally, in a conventional electronic digital watch having a quartz element for a time standard, a time amending or correction operation is a complicated one in spite of the fact that time correction is basically simple because of the number of switching members which must be operated. Namely in a watch for displaying hours, minutes and seconds, it is possible to change the position of second and minute hands by the rotation and pulling of a watch stem. But in a digital watch, it is necessary to operate at least three switches for amending hours, minutes and seconds.

Because of advances in electronic circuitry there has been a recent trend of incorporating multiple functions in electronic digital watches, and as a result the watch operation has become more complicated, and the number of switches for the watch has increased. However the switching operation of the electronic watch has to be simple for the general user. Further there is a danger of user forgetting the way to operate the watch switches for time correction because time correction is infrequently necessary. The present invention aims to eliminate the above noted difficulty and insufficiency.

SUMMARY OF THE INVENTION

The object of the present invention is to provide a simplified switching structure for operating a plurality of functions in a digital alarm watch; for example a time amendment, operation of a lamp, a selection of multi-channels, setting and resetting of said multi-channels and alarm termination.

DESCRIPTION OF THE PREFERRED EMBODIMENT

Figures 1, 2:
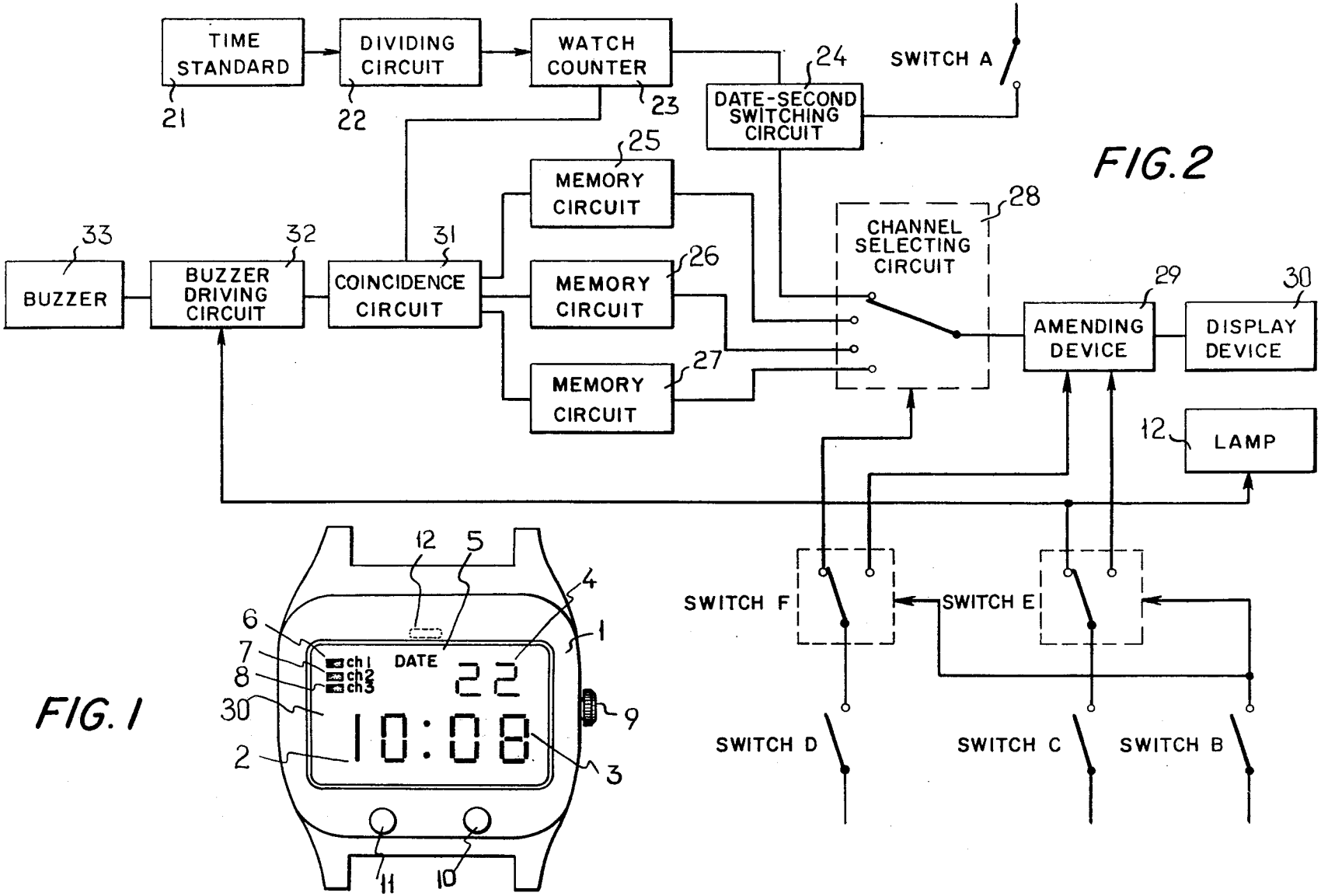
FIG. 1 shows a flat plan view of a digital alarm watch of the present invention.
FIG. 2 shows a block diagram of the circuitry of the watch in FIG. 1.

FIG. 1 shows a flat plan view of multi-alarm watch, wherein numeral 1 shows a watch, numeral 2 shows an hours display, numeral 3 shows a minute display, numeral 4 shows a digit for selectively displaying a date and seconds according to operation of a, and wherein the display of DATE 5 is displayed.

Numerals 6, 7 and 8 are displays for respectively indicating operation of a first channel, second channel and third channel, and numeral 12 is a lamp for lighting a display panel in the dark.

A first switch member 9 is of the push-pull stem type. A switch A is operated to ON and OFF by the pushing of said switch member 9 because switch A is connected to said switch member 9, and a switch B is operated to ON and OFF by the pushing and pulling of said switch member 9. Numerals 10 and 11 indicate push type switches, switches C and D are operated by the operation of said switches 10 and 11. A lamp 12 is lighted by the pushing of said push switch 10 namely when the switch C is ON and while the switches E and F are switched to the contacts illustrated at the left side thereof, and said push-pull switch remains in the normal condition with said switches A and B are positioned OFF. The buzzer 33 is stopped by the operation of the stopping circuit, connected to a buzzer driving circuit 32, during operation of the buzzer by switching said switch 10.

The contents of a watch counter 23 and memory circuits 25, 26 and 27 are respectively displayed by the display device 30 together with the channel information displayed on portions 6, 7 and 8 when the contents of the counter 23 and memory circuits 25–27 are applied to the display 30 by the channel selecting circuit 28 when the switch 11 is pushed, namely when said switch F is ON. Said switches E and F are set to contact of right side contacts and said switch B is changed to the ON-condition when said switch 9 is pulled to a selected condition. When said switch 11 is pushed said switch D is set to the ON-condition.

The amended to corrected time is determined by the contents in said watch counter 23 which is displayed or the contents of one of said memory circuits 25, 26 and 27 which is displayed. The amending device 29 is operated to correct the displayed time by pushing of said switch 10, namely turning switch C ON. The corrected time selecting condition is restored to the normal display condition by said switches E and F being switched from the right side contacts when said switch B is in the OFF-condition after completing the correction for each of the figures of date, hour, minute and second in a selected channel by the alternate operation of said switch 11, namely switch D, and said switch 10, namely switch C. The date and second switching circuit 24 is operated by the switching ON said switch A and the pushing of said switch member 9, whereby the date-second-date displays are sequentially displayed by to said display portion 4, and the DATE display 5 is displayed by to said display portion 4, and the DATE display 5 is displayed during display of the date. The buzzer 33 is driven by the conincidence circuit 31 via the buzzer driving circuit 32 when the contents of said memory circuits 25, 26 and 27 coincide with to the times represented by the contents of said watch counter 23 being driven by the output signal of time standard 21 via the dividing circuit 22.

According to the above described structure, the date and seconds are selectively displayed by said display portion 4 by the pushing of said switch member 9.

Said switch 11 is operated to select the channels and to display the contents of said memory circuits by a single operation of said switch 11, and to designate the preferable time figure in the date, hour, minute and second after said switch member 9 is pulled.

Said switch 10 is able to stop said buzzer 33 and to light said lamp 12 by a single operation of said switch 10, and to amend the corrected time being designated by said switch 11 and to reset the second after said switch 9 is pulled. Therefore said switches 10 and 11 can have different functions depending upon the setting of said push-pull type switch member 9, whereby it is possible to operate many functions by a few outer operative switch members, for example push-pull and push switches.

I claim:

1. A digital alarm timepiece comprising: time standard means for generating a repetitive time standard signal for defining passage of time; dividing means receptive of said time standard signal for dividing the same and for developing a repetitive output signal having a repetition rate less than that of said time standard signal; a counter receptive of said dividing means output signal for counting the same and for developing a count representative of time and date; date-second switching circuit means cooperative with said counter for switching between a count representative of seconds and a count representative of date; a plurality of memory circuits each defining a different channel and each for storing a time signal representative of a time; a display responsive to the contents of said counter and to said time signals for displaying the time corresponding thereto; channel selecting means for applying a selected one of the time signals stored in one of said memories or the count switched by said date-second switching circuit means to display a selected time or a date or seconds; a coincidence circuit for comparing the count developed by said counter with the time signals stored in said memories and for developing an output signal when the count and one of said time signals coincide; means for actuating said channel selecting means, wherein said means for actuating said channel selecting means comprises a switching circuit operable between two states, a first switch connected for applying a signal to change the state of said switching circuit, and a second switch connected in series with said switching circuit for controlling application of an actuating signal to said channel selecting means through said switching circuit when the same is in a conductive state; alarm means responsive to the output signal of said coincidence circuit for sounding an alarm, wherein said alarm means is responsive to a control signal for terminating operation of the same; and means for applying a control signal to said alarm means, wherein the last-mentioned means includes a second switching circuit operable between two states, said first switch connected for applying a signal to change the state of said second switching circuit, and a third switch connected in series with said second switching circuit for controlling application of the control signal to said alarm means through said second switching circuit when the same is in a conductive state.

* * * * *